US005385228A

United States Patent [19]

Vidoni et al.

[11] Patent Number: 5,385,228

[45] Date of Patent: Jan. 31, 1995

[54] CONVERTIBLE CONTAINER

[75] Inventors: Daniel P. Vidoni, Toronto; James Morison, Oshawa, both of Canada

[73] Assignee: Gorrie Advertising Management Limited, Mississauga, Canada

[21] Appl. No.: 160,305

[22] Filed: Dec. 1, 1993

[30] Foreign Application Priority Data

Dec. 1, 1992 [CA] Canada ..... 2084265

[51] Int. Cl.[6] ..... B65D 75/58; B65D 5/50

[52] U.S. Cl. ..... 206/44.12; 206/45.15; 206/45.18; 206/45.19

[58] Field of Search ..... 206/44.12, 45.15, 45.18, 206/45.19, 45.16, 45.11, 45.12

[56] References Cited

U.S. PATENT DOCUMENTS

| | | | |
|---|---|---|---|
| 1,519,051 | 12/1924 | Rayner | 206/45.18 |
| 1,592,922 | 7/1926 | Burnham | 206/45.18 |
| 2,922,552 | 1/1960 | Berger et al. | 206/44.12 |
| 4,805,765 | 2/1989 | Barrett et al. | 206/45.12 |

FOREIGN PATENT DOCUMENTS

| | | | |
|---|---|---|---|
| 916661 | 1/1963 | United Kingdom | 206/45.16 |
| 1434759 | 5/1976 | United Kingdom | 206/44.12 |

OTHER PUBLICATIONS

Gorrie Advertising Services Ltd. "The Conquest of Space–The Space Management System" (1989).

*Primary Examiner*—William I. Price
*Attorney, Agent, or Firm*—Bereskin & Parr

[57] ABSTRACT

The invention provides a container that is used for shipping and displaying a product. The container is convertible from a shipping configuration, where the product is encased, to a dispensing configuration, where the product may be displayed and dispensed at a retail outlet. The container includes a weakened seam that permits easy removal of a portion of the container body to define an aperture for displaying and dispensing the product. Openings are provided in the bottom surface of the container to permit attachment of a dispensing tray for receiving product dispensed through the aperture. One embodiment of the container includes a floor that slopes towards the aperture to assist the dispensing of product. In another embodiment of the container, the floor is pivoted with the assistance of tabs located on the dispensing tray. The dispensing tray includes a groove defined in its base that is adapted to cooperate with a lip protruding from a product shelf to secure the container tray to the shelf.

12 Claims, 5 Drawing Sheets

CONVERTIBLE CONTAINER

FIELD OF THE INVENTION

The present invention relates to the field of product packaging and display, and in particular to a container that is convertible from a shipping configuration, where the product is encased, to a dispensing configuration, where the product may be displayed and dispensed into attachable dispensing trays.

BACKGROUND OF THE INVENTION

Manufacturers or distributors often transport products in containers that contain many units of the product in each container. Typically, the containers are stored in a warehouse or back room of a retail outlet and the product is periodically removed from the containers to replenish the stock on display.

It is sometimes desirable to keep an inventory of the product at the retail portion of the outlet and to dispense the product directly from its container to customers. For instance, certain mix-and-match items, such as nuts and bolts, plumbing fittings, mouldings, and other hardware items are preferably displayed in loose form directly from their containers to allow customers to choose the quantity and mixture of items they require. In addition to making space available in the warehouse for storage of other products, the above described arrangement reduces costs by minimizing the time spent by retail clerks in stocking shelves.

Recently, a product display unit was developed for displaying such mix-and-match items in their containers. The display unit included a rear storage area for storing an inventory of containers, and a front display area for displaying and dispensing the products in their containers. Containers from the rear storage area would be opened by a retail clerk and placed in the front display area with a product dispensing tray attached. The in-store display could thus be relatively easily replenished by the retail clerk. The containers used with the above-described display unit were difficult to open however. This was an inconvenience to the retail staff, and the resulting disfigurement of the containers detracted from the attractive presentation of the display.

It is desired that an improved product container be developed for use on its own or in the above-described product display units. The improved container would be suitable for shipping a product and would be easily transfigured for display purposes. The container would optionally include a floor that slopes to assist the dispensing of product. The dispensing tray used with the container would be improved to include a means for securing the container to a shelf.

SUMMARY OF THE INVENTION

In a first aspect, the invention provides a container for shipping and dispensing a product, comprising:

(a) a hollow body for containing said product, said body being convertible from a shipping configuration, where said body encases said product for shipping, to a dispensing configuration, where a portion of said body is removed to define an aperture for dispensing said product; and (b) a weakened seam extending along the surface of said body to define the perimeter of said removable portion and to permit easy removal of said portion;

wherein said removable portion is severed from said body along said weakened seam to convert said body from said shipping configuration to said dispensing configuration.

In other aspects, the invention provides a container in combination with a dispensing tray, and a container in combination with a retail display unit.

BRIEF DESCRIPTION OF THE DRAWINGS

For a better understanding of the present invention, and to show more clearly how it may be carried into effect, reference will now be made, by way of example, to the accompanying drawings. The drawings show a preferred embodiment of the present invention, in which.

DETAILED DESCRIPTION OF THE PREFERRED EMBODIMENT

A container in accordance with the present invention is shown generally at 12 in FIGS. 1–10.

Figure 1:
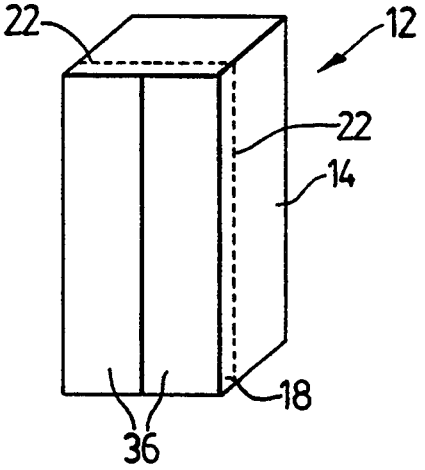
FIG. 1 is a perspective view of a first embodiment of a container in a shipping configuration.
Figures 6, 7, 8:
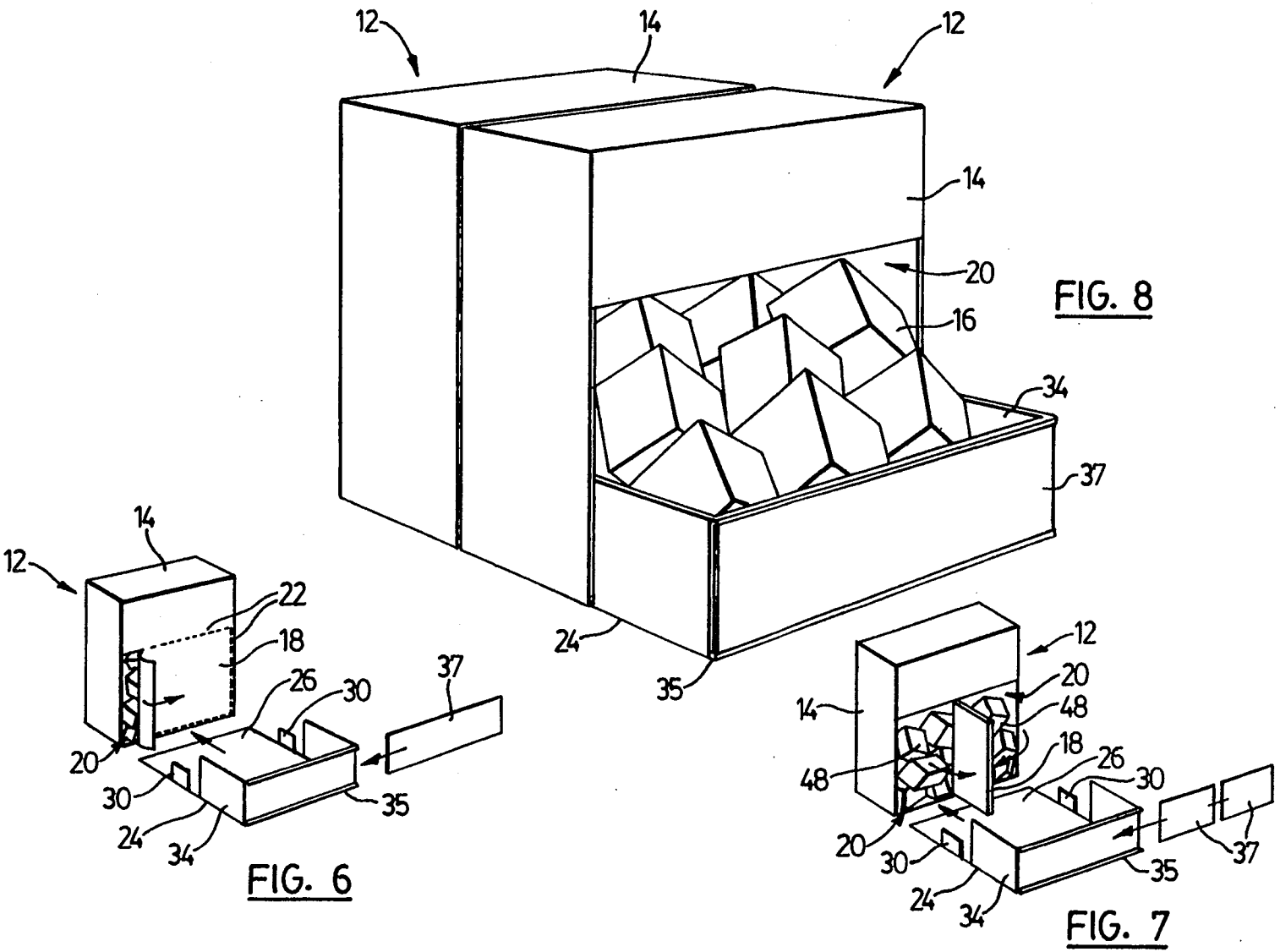
FIG. 6 is an exploded, perspective view of a third embodiment of a container, with a dispensing tray and placard.
FIG. 7 is an exploded, perspective view of a fourth embodiment of a container, with a dispensing tray, and placards.
FIG. 8 is a perspective view of a container with product being dispensed into a dispensing tray, and a replacement container in a shipping configuration behind it.

The container 12 has a hollow body 14 for containing a product 16 as shown in FIG. 8. The body 14 may be constructed from any lightweight, inexpensive material but cardboard is preferred. The body 14 is convertible from a shipping configuration (as shown in FIGS. 1, 3 and 6), where the body 14 encases the product 16, to a dispensing configuration (as shown in FIGS. 2, 4, and 7–9), where a portion 18 of the body 14 has been removed to define an aperture 20 for dispensing the product 16. The body 14 has a bottom surface 28 upon which the body 14 rests when in the dispensing configuration. Side walls 31, in the dispensing configuration, extend upwardly from the bottom surface 28. The convertible nature of the body 14 allows the container 12 to be used both for shipping the product 16 to a retail outlet and for displaying and dispensing the product 16 at the retail outlet.

The body 14 features a weakened seam 22, as shown by dashed lines in FIGS. 1, 3, and 6. The weakened seam 22 permits the removable portion 18 to be easily removed to define the aperture 20. The weakened seam 22 thus defines the perimeter of the removable portion 18 or aperture 20. The seam 22 may be formed along the surface of the container 12 in a range of configurations, and examples of four possible embodiments are described below.

The weakened seam 22 is preferably either a score line or a perforated line that is weak enough to be severable when a force is directly applied to the seam 22. The seam 22 is not so weak however as to become severed during shipping of the container 12.

Figure 5:
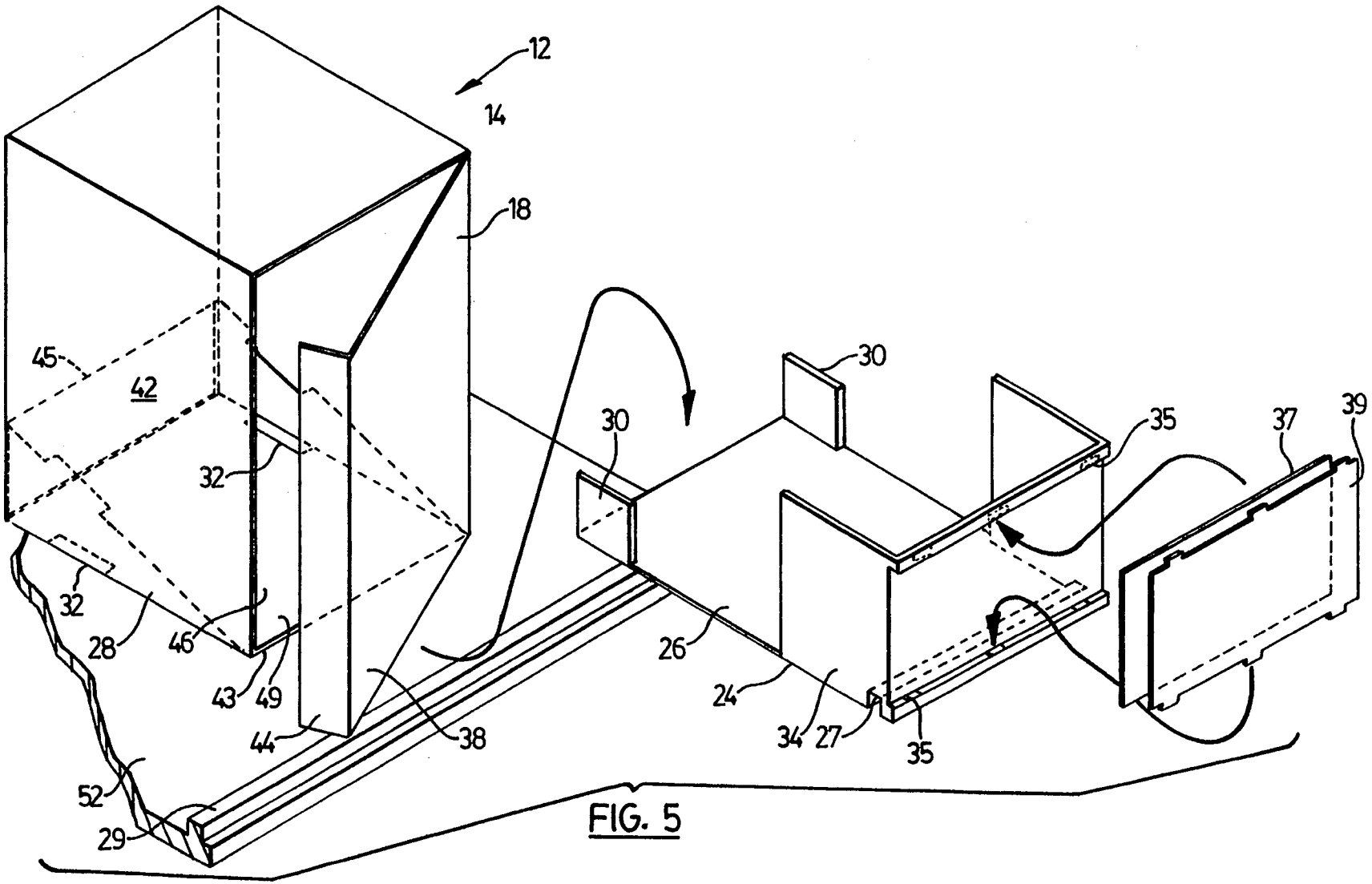
FIG. 5 is an exploded perspective view of the second embodiment of the container, dispensing tray, and placard in accordance with the present invention.

The container 12 is adapted to be combined with a dispensing tray 24 for displaying and dispensing the product 16 at the retail outlet. The dispensing tray is typically constructed from a plastic material although alternative materials, such as cardboard or metal, may be used. The dispensing tray 24 includes a base 26 that extends beneath the bottom surface 28 of the body 14 of the container 12. The base 26 includes tabs 30 that are sized to extend through openings 32 defined in the bottom surface 28 of the container 12. The dispensing tray 24 may thus be attached to the container 12 when the container 12 is in the dispensing configuration. As shown in FIG. 5, the dispensing tray 24 may further include a groove 27 defined along the underside of the base 26 in a direction that is generally parallel to the aperture 20 of the container 12 when the dispensing tray 24 is attached. The groove 27 is adapted to receive a lip 29 protruding from a product shelf 52 in order to secure the tray 24 to the shelf 52.

The dispensing tray 24 also includes a fence 34 or other suitable means for forming a receptacle with the base 26 and the body 14 of the container 12. The fence 34 has a front portion and two side portions, dimensioned to form extensions of the container side walls 31 in the dispensing configuration. The front portion of the fence 34 includes a means 35 for receiving a placard 37, as shown in FIGS. 5–9. The placard 37 may be used to provide promotional information to the retail customer. A placard cover 39 may be provided to secure the placard 37 within the receiving means 35.

Figure 2:
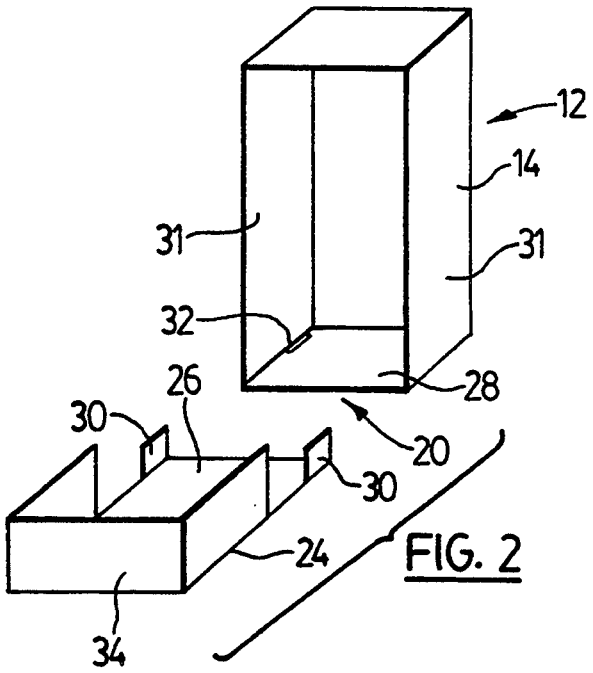
FIG. 2 is an exploded perspective view of the first embodiment of the container in a dispensing configuration with a dispensing tray.
Figure 3:
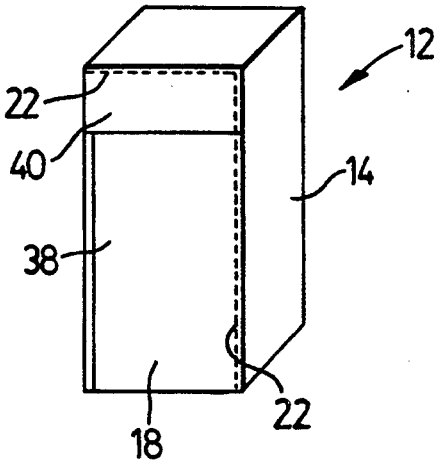
FIG. 3 is a perspective view of a second embodiment of the container in a shipping configuration.

In a first embodiment of the container 12, as shown in FIGS. 1 and 2, the weakened seam 22 extends entirely about the circumference of the body 14 (see FIG. 1). This enables an entire side of the body 14 to be removed to convert the body 14 to the dispensing configuration (see FIG. 2). The body 14 is initially closed, to encase the product 16 in the shipping configuration, by folding a number of conventional flaps 36 as known in the art. The flaps 36 may be secured with glue, tape or staples (not shown).

Figure 4:
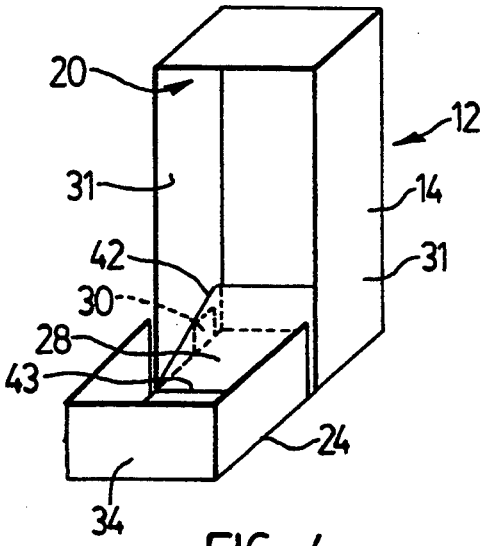
FIG. 4 is a perspective view of the second embodiment of the container in a dispensing configuration with the dispensing tray attached.

In a second embodiment of the container 12, as shown in FIGS. 3–5, the weakened seam 22 extends along the edges of a closure flap 38 and a securement flap 40. This flap arrangement is preferred when the container 12 includes a floor 42, described further below. To initially place the container 12 into a shipping configuration, a tongue 44 of the closure flap 38 is tucked along a corresponding inside surface 46 of the body 14 to close the aperture 20. The securement flap 40 is then folded over the closure flap 38 and attached with glue, tape, or staples (not shown) to secure the closure flap 38. The body 14 may subsequently be easily converted to the dispensing configuration by, for example, inserting one's hand between the tongue and the inside surface of the body 14 and lifting the closure flap 38 to sever the weakened seams 22 of the closure and securement flaps 38, 40.

In a third embodiment of the container 12, as shown in FIG. 6, the weakened seam 22 extends along a part of one side of the body 14. Thus, a lower portion 18 of the body 14 is removable to define the aperture 20.

In a fourth embodiment of the container 12, as shown in FIG. 7, the body 14 of the container 12 has two compartments 48 for receiving two different products 16. The weakened seam 22 is arranged so that two apertures 20 are defined. The removable portions 18 may remain partially attached to separate the products 16 within the dispensing tray 24.

Figure 10:
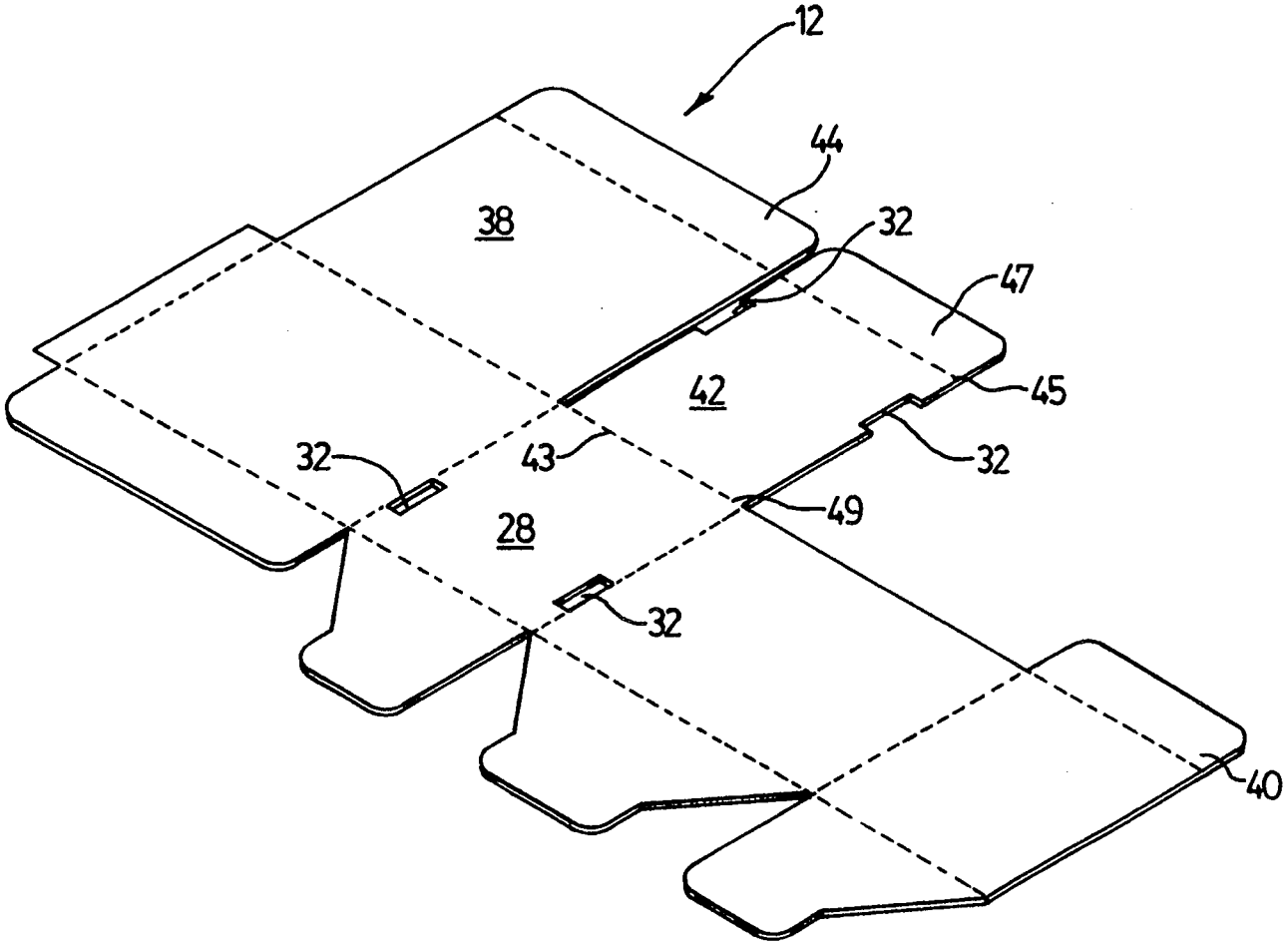
FIG. 10 is a perspective view of a die-cut pattern for the second embodiment of the container.

The container 12 may additionally include a floor 42, two examples of which are shown in FIGS. 4 and 5. The floor 42 overlays the bottom surface 28 of the body 14 and slopes downwardly toward the aperture 20 to assist the dispensing of product (a die cut pattern for such a container arrangement is shown in FIG. 10 with the fold lines indicated with dashed lines).

In the example shown in FIG. 5, a first end 45 of the floor 42, opposite to the aperture 20, includes a support member 47 that supports the floor 42 in a sloping position. The support member 47 extends downwardly from the first end 45 to the bottom surface 28 of the container 12. The support member 47 thus raises the first end 45 and supports the floor 42 in the sloping position. Openings 32 may be defined in the floor 42 so that the floor 42 does not interfere with the tabs 30 of the dispensing tray 24 extending through similar openings 32 in the bottom surface 28. A second end 49 of the floor 42 is attached to the body 14 along a common edge 43 with the bottom surface 28. The common edge 43 is located adjacent to the aperture 20.

Rather than being permanently fixed in the sloping position, it is conceivable that the floor 42 may be pivotable between a flat position and the sloping position. An example of such an arrangement is shown in FIG. 4. When the container 12 is in the shipping configuration, the floor is in the flat position and rests generally parallel to, or flat against, the bottom surface 28 of the container 12. This maximizes the space available within the body 14 of the container 12 for holding product 16. When the body 14 is converted to the dispensing configuration, the floor is pivoted to the sloping position and slopes downwardly toward the aperture 20. As shown in FIG. 4, the floor 42 may be pivoted with the assistance of the tabs 30 (shown in phantom) of the dispensing tray 24 when the dispensing tray 24 is attached to the container 12. The tabs 30 of the tray 24 extend through the openings 32 in the bottom surface 28 of the body 14 and meet the underside of the floor 42 to pivot the floor into its sloping position. In this case, the floor 42 does not include the support member 47 or the openings 32.

Figure 9:
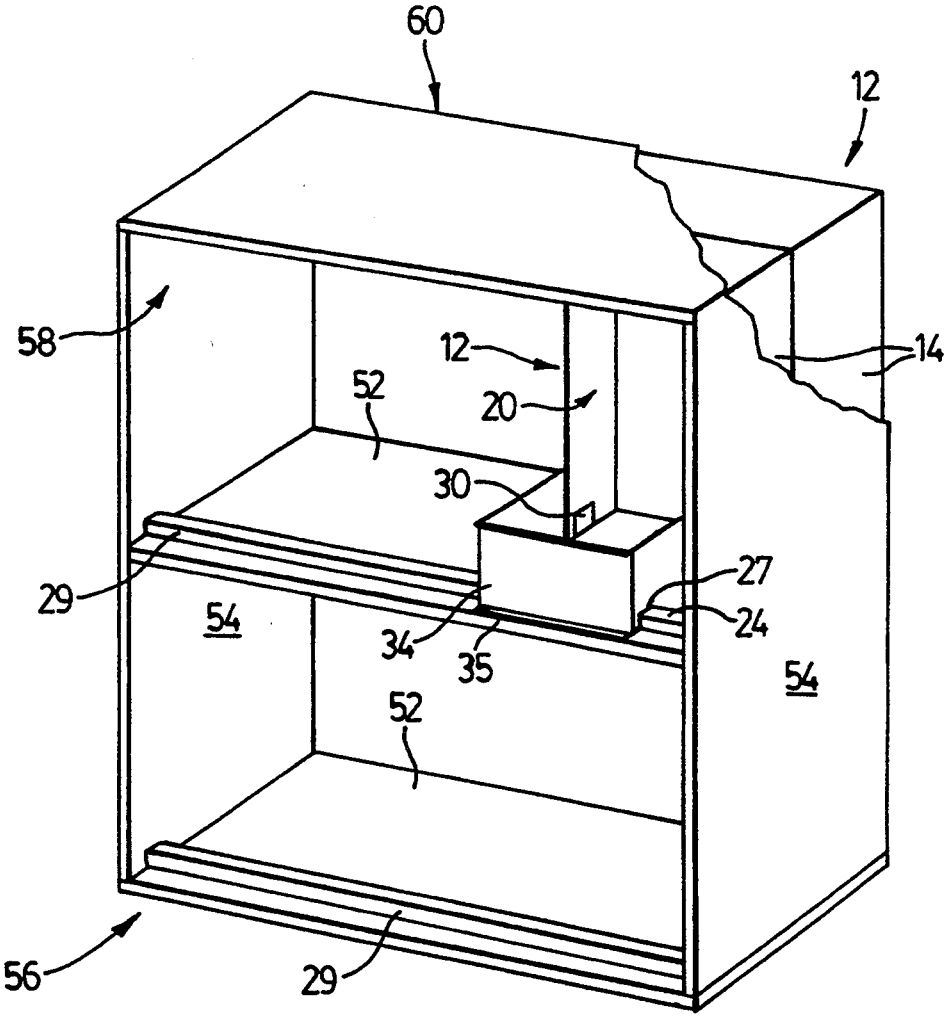
FIG. 9 is a perspective, partial sectional view of a product display unit and two containers mounted therein.

The container 12 and dispensing tray 24 are intended to be arranged in the dispensing configuration on a shelf 52 at a retail outlet. The shelf 52 may be supported by a frame 54 of a product display unit shown generally at 56 in FIG. 9. The display unit 56 includes sufficient space for a display area 58 at the front of the unit 56 for arranging the containers 12 in their dispensing configuration to allow access by customers. The display unit 56 also includes sufficient space for a storage area 60 at the rear of the unit 56 for storing an inventory of containers 12 in their shipping configuration (FIG. 9 shows a container in its shipping configuration being stored behind a container in its dispensing configuration). As described earlier, the shelf 52 may include a protruding lip 29 that is adapted to extend into the groove 27 defined in the base of the dispensing tray 24. The dispensing tray 24 and container 12 are thus secured to the shelf 52 and are less likely to slide or fall from the shelf 52 when a customer is removing product. The tray 24 is raised to release the lip 29 from the groove 27 when it is desired to remove the container 12 and tray 24 from the shelf 52.

When a container 12 on display is empty, it is removed from the display area 58, and the dispensing tray 24 is detached. The container 12 is then discarded and preferably recycled. A replacement container 12 is then obtained from the storage area 60 and converted to a dispensing configuration. The dispensing tray 24 is then attached to the container 12 and the full container 12 and tray 24 are placed in the display area 58 of the display unit 56 and locked to the shelf 52.

It is to be understood that what has been described are preferred embodiments of the invention. The invention nonetheless is susceptible to certain changes and alternative embodiments fully comprehended by the spirit of the invention as described above, and the scope of the claims set out below.

We claim:

1. A container for shipping and dispensing a product, comprising:

a hollow body for containing said product, said body being convertible from a shipping configuration, where said body encases said product for shipping, to a dispensing configuration, where a portion of said body is removed to define an aperture for dispensing said product, said body having a bottom surface upon which said body rests when in said dispensing configuration:

an opening defined in said bottom surface for receiving a tab extending from a dispensing tray, said dispensing tray being attachable to said body to receive product from said aperture when said body is in said dispensing configuration; and a weakened seam extending along the surface of said body to define the perimeter of said removable portion and to permit easy removal of said portion;

wherein said removable portion is severed from said body along said weakened seam to convert said body from said shipping configuration to said dispensing configuration.

2. A container as claimed in claim 1, further comprising a floor located within said body and overlaying said bottom surface, said floor sloping downwardly towards said aperture to assist the dispensing of said product.

3. A container as claimed in claim 2, wherein said floor includes a support member for supporting said floor in a sloping position, said support member being located at a first end of said floor opposite to said aperture, and said support member extending from said first end to said bottom surface to raise said first end and support said floor in said sloping position.

4. A container as claimed in claim 2, wherein said floor is pivotable from a flat position when said body is in said shipping configuration, where said floor is generally parallel to said bottom surface, to a sloping position when said body is in said dispensing configuration, where said floor slopes downwardly toward said aperture, said floor being pivoted into said sloping position by said tab of said dispensing tray.

5. A container as claimed in claim 4, wherein a second end of said floor adjacent to said aperture is attached to said body along a common edge with said bottom surface.

6. A container as claimed in claim 4, in combination with said dispensing tray.

7. A container as claimed in claim 4, in combination with said dispensing tray, wherein said dispensing tray includes a base having a groove defined in the underside thereof, said groove being adapted to correspond with a lip protruding from a shelf to secure said container and said dispensing tray to said shelf.

8. A container as claimed in claim 4, in combination with said dispensing tray, wherein said dispensing tray includes a base having a groove defined in the underside thereof, said groove being adapted to correspond with a lip protruding from a shelf to secure said container and said dispensing tray to said shelf, and wherein said dispensing tray includes means for supporting a placard.

9. A container as claimed in claim 1, in combination with a dispensing tray comprising a base, said tab extending upwardly from said base, and a fence extending upwardly from the front of said dispensing tray, said fence being configured to form an extension of the container in the dispensing configuration.

10. A combination as claimed in claim 9, wherein said dispensing tray includes a groove adapted to engage a corresponding lip of a shelf.

11. A combination as claimed in claim 10, wherein said fence of said dispensing tray includes means for supporting a placard.

12. A combination as claimed in claim 11, further including a retail display unit, wherein said retail display unit has at least one shelf secured in a frame, a display area for displaying said container and said dispensing tray in said dispensing configuration, and a storage area for storing said container in said shipping configuration, and wherein said container is mounted in one of said display and storage areas.

* * * * *